US009109178B2

(12) United States Patent
Salavatova et al.

(10) Patent No.: US 9,109,178 B2
(45) Date of Patent: Aug. 18, 2015

(54) ANTIOXIDANT ADDITIVE COMPOSITION, A SOLUTION THEREOF, AND A METHOD FOR IMPROVING THE STORAGE STABILITY OF BIODIESEL FUEL (VARIANTS)

(71) Applicant: OTKRYTOE AKTSIONERNOE OBSCHESTVO "STERLITAMAXKY NEFTEKHIMICHESKY ZAVOD", Bashkortostan (RU)

(72) Inventors: Roza Minizievna Salavatova, Bashkortostan (RU); Nikolai Arkadievich Niyazov, Bashkortostan (RU)

(73) Assignee: Oktrytoe Aktsionernoe Obschestvo "Sterutamaxky Neftekhimichesky Zavod", Sterlitamak (RU)

( * ) Notice: Subject to any disclaimer, the term of this patent is extended or adjusted under 35 U.S.C. 154(b) by 289 days.

(21) Appl. No.: 13/788,073

(22) Filed: Mar. 7, 2013

(65) Prior Publication Data

US 2013/0232859 A1 Sep. 12, 2013

(30) Foreign Application Priority Data

Mar. 7, 2012 (RU) ..... 2012108890

(51) Int. Cl.
*C10L 1/185* (2006.01)
*C10L 1/183* (2006.01)

(52) U.S. Cl.
CPC ..... *C10L 1/1857* (2013.01); *C10L 1/183* (2013.01); *C10L 1/1832* (2013.01); *C10L 1/1835* (2013.01); *C10L 2200/0476* (2013.01); *C10L 2230/081* (2013.01)

(58) Field of Classification Search
CPC ..... C10L 1/1857; C10L 1/1832; C10L 1/183
See application file for complete search history.

(56) References Cited

U.S. PATENT DOCUMENTS 2,505,817 A * 5/1950 Whitaker et al. ..... 568/362
2006/0219979 A1 10/2006 Asbahr et al.

FOREIGN PATENT DOCUMENTS

| | | | |
|---|---|---|---|
| DE | 102 52 715 | A1 | 5/2004 |
| EP | 0 189 049 | | 7/1986 |
| RU | 2 340 655 | C2 | 12/2008 |
| WO | 2008/065015 | A1 | 6/2008 |

OTHER PUBLICATIONS

Simkovsky N.M. et al, Effect of antioxidants on the Oxidative Stability of Rapessed Oil Methyl Esters; Jun. 1999.

* cited by examiner

*Primary Examiner* — Cephia D Toomer
(74) *Attorney, Agent, or Firm* — Ladas & Parry LLP

(57) ABSTRACT

This invention relates to the petrochemical industry, in particular, to a method for improving the storage stability of biodiesel fuel via using an antioxidant additive.

Figure 1:
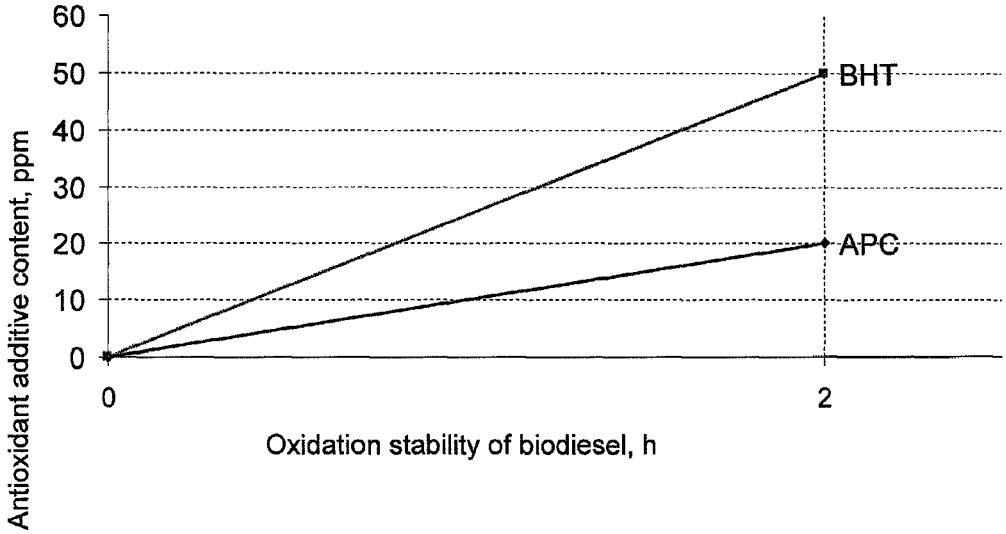

A method for improving the storage stability of biodiesel fuel, comprising addition of an alkylphenol-based antioxidant additive via providing an initial solution that contains 6 to 48 mass % of the alkylphenol-based composition comprised of, mass %:

2,6-di-tert-butyl-4-methylcyclohexanone—0.2-0.3;
2,6-di-tert-butylphenol—0.7-6.0;
2-sec-butyl-6-tert-butyl-p-cresol—1.5-5.0;
4,6-di-tert-butyl-o-cresol—3.0-8.0;
2,4-di-tert-butylphenol—0.3-0.5;
2,4-di-tort-butyl-6-dimethylaminomethylphenol—2.0-5.0;
4,4-methylene-bis(2,6-di-tert-butylphenol)—0.1-0.3; and
2,6-di-tert-butyl-4-methylphenol—to the balance, dissolved in biodiesel fuel; and adding the solution of the composition to the biodiesel fuel to reach a concentration of the composition of from 0.002 to 1.6 mass % based on the entire biodiesel fuel solution.

The technical result consists of a considerable improvement of the storage stability of biodiesel fuel with a reduced amount of the antioxidant additive. The antioxidant additive used inhibits precipitation during the shelf life of biodiesel fuel for a longer period of time.

3 Claims, 2 Drawing Sheets

ANTIOXIDANT ADDITIVE COMPOSITION, A SOLUTION THEREOF, AND A METHOD FOR IMPROVING THE STORAGE STABILITY OF BIODIESEL FUEL (VARIANTS)

TECHNICAL FIELD

This invention relates to the petrochemical industry, in particular, to a method for improving the storage stability of biodiesel fuel via using an antioxidant additive.

BACKGROUND OF THE INVENTION

Saving oil-derived energy sources, tightening emission standards for the exhaust gases of diesel engines, and limiting carbon dioxide emissions, cause the majority of countries to look for ways to reduce the impacts of thermal engines on the environment. Alternative biofuels based on vegetable oils and animal fats have recently become all the more widespread. Biodiesel fuels (or biodiesels) are produced via transesterification of vegetable oils (triglycerides of higher fatty acids), such as rapeseed oil, soybean oil, palm oil, sunflower oil, and others, and animal fats, with methanol, more rarely with ethanol or isopropanol, in the presence of potassium or sodium hydroxide to serve as a catalyst. Biodiesels represent mixtures of methyl fatty acid esters; they are environmentally promising fuels on the international market. Biodiesel is used as a fuel for diesel and automobile engines, combined heat and power blocks, ships and boats, as well as for stationary diesel engines of trackless land vehicles with motor drive. Biodiesel is a nontoxic, naturally degradable type of fuel; it is virtually free of sulfur and carcinogenic benzene and is derived from renewable resources which are not conductive to the accumulation of gases that cause the greenhouse effect (CO, $CO_2$, $SO_2$, fine particulates, and volatile organic compounds) as opposed to oil-derived fuel. The advantages of biodiesel include good lubricating characteristics (which prolong the life of the engine), higher cetane numbers, and facilitation of cleaning injectors, fuel pumps, and fuel supply channels.

One drawback of biodiesel fuel is its limited storage stability. This is on account of high contents of methyl esters of unsaturated fatty acids, which progressively deteriorate over time the energy value of this fuel and lead to precipitation (which is recognized as fuel clouding) as a result of oxidative degradation to short-chain products. The products formed in the course of degradation of unsaturated fatty acid esters, namely, peroxides, aldehydes, and free short-chain fatty acids, lead to sparingly soluble precipitations and cause metal corrosion in the engine and injection system, and shorten the life of the engine and its power.

Oil-derived diesel fuels are used with a wide spectrum of additives that improve the oxidation stability and other properties thereof. Biodiesel additives are yet far fewer, but they considerably extend the capabilities of this type of biofuel. A stabilizer additive is especially important for biodiesels derived from vegetable oils with high unsaturated fatty acid contents.

A method is known for improving the stability of biodiesel fuel, comprising addition to the biodiesel of the main antioxidant in an amount of from 10 to 20 000 ppm (parts per million) and further the addition of a secondary antioxidant. Herein, the main antioxidant represents bisphenol and is dissolved in an organic solvent before being added to the biodiesel (see US 2006/0219979 A1 C09K15/04, publ. Oct. 5, 2006).

A drawback of this method consists of the complexity of biodiesel stabilization, wherein the additives used create an insufficiently long-lasting stabilizing effect when added to the biodiesel.

The use of 3,5-di-tort-butyl-4-hydroxytoluene and/or tocopherol in concentrations of up to 500 ppm is known for stabilizing mixtures of methyl esters of fatty acids having carbon numbers of from 12 to 18 and prepared by transesterification of palm oil with methanol (see EP 0189049 A1 C07C69/24, C07C67/62, C11B5/00, publ. Jan. 7, 1986).

The antioxidant additives used in this method create an insufficiently long-lasting stabilizing effect when added to the biodiesel.

Various antioxidant biodiesel additives were studied in "Effect of Antioxidants on the Oxidation stability of Rapeseed Oil Methyl Esters" by Simkovsky, N. M., and Ecker, A., Analytik, 1999, no. 6, pp. 317-318.

Phenylenediamines (such as Irganox L57 and Irganox L74) and sterically hindered phenols (Hitec 4702, BHT (4-methyl-2,6-di-tert-butyltoluene), Ionol CP, Lowinox, and propyl gallate) in an amount of 300 ppm were shown to cause an extremely low stabilizing effect at 120° C. and a little better effect at 100° C. and 90° C.

A method is known for improving the storage stability of diesel biofuel, comprising addition of a liquid initial solution containing 2,6-di-tert-butylhydroxytoluene (BHT) in an amount of 15 to 60 mass % of based on the initial solution dissolved in diesel biofuel, to the diesel biofuel to be stabilized to reach a 2,6-di-tert-butylhydroxytoluene concentration of 0.005 to 2 mass % based on the entire diesel biofuel solution (see patent RU 2340655 C10L1/183, publ. Dec. 10, 2008).

The antioxidant additive used in this method creates an insufficiently long-lasting stabilizing effect when added to the biodiesel fuel in relatively high dosages.

It follows that additives providing a considerable improvement of the storage stability of biodiesel fuel are hitherto unknown.

SUMMARY OF THE INVENTION

The object of the present invention is to considerably increase the storage stability of diesel biofuel.

To fulfill this object, an alkylphenol-based antioxidant additive composition is proposed, wherein the composition is comprised of, in mass %:

2,6-di-tert-butyl-4-methylcyclohexanone—0.2-0.3
2,6-di-tert-butylphenol—0.7-6.0
2-sec-butyl-6-tert-butyl-p-cresol—1.5-5.0
4,6-di-tert-butyl-o-cresol—3.0-8.0
2,4-di-tert-butylphenol—0.3-0.5
2,4-di-tert-butyl-6-dimethylaminomethylphenol—2.0-5.0
4,4-methylene-bis(2,6-di-tert-butylphenol)—0.1-0.3 and
2,6-di-tert-butyl-4-methylphenol—to the balance.

One more object of the invention is to provide a solution of an alkylphenol-based antioxidant additive composition to be added to biodiesel fuel, comprising the aforementioned alkylphenol-based antioxidant additive composition in a concentration of 6 to 48 mass % in the biodiesel fuel.

Unexpectedly it was discovered that the aforementioned composition wherein each component is a known antioxidant can cause a more significant and longer lasting antioxidant effect when added to biodiesel fuel in the specified amounts in a relatively low dosage. For comparison, when BHT and 2,6-di-tert-butylphenol are added to biodiesel fuel in a dosage of 2500 ppm, the antioxidant effect is retained for 10.3 h and 8.3 h, respectively (see WO 2008/065015 A1 C10L1/02, C10L1/14, C10L10/00, publ. Jun. 5, 2008), whereas when the claimed alkylphenol composition is added to biodiesel fuel in a lower dosage (less than 1900 ppm), the antioxidant effect is retained for more than 10.0 h. When 4,6-di-tert-butyl-o-cresol, a known antioxidant which is a component of the claimed composition, is added to biodiesel fuel in the same dosages as the claimed antioxidant additive, the antioxidant effect is also retained for a shorter period of time than when the claimed alkylphenol composition is added to biodiesel fuel (see DE 10252715 A1 C10L1/02, C10L1/183, C10L1/18, C10L1/08, publ. May 27, 2004). Another known antioxidant (Ionol 220; 4,4-methylene-bis(2,6-di-tert-butylphenol), when added to biodiesel fuel in a dosage of 500 ppm, causes an antioxidant effect lasting 8.0 h (see US 2006/0219979 A1 C09K15/04, publ. Oct. 5, 2006), against a period of longer than 8.0 h for the claimed alkylphenol composition added in the same dosage.

Further, a method is proposed for improving the storage stability of biodiesel fuel, comprising addition of an alkylphenol-based antioxidant additive via providing an initial solution containing from 6 to 48 mass % of the alkylphenol-based composition, wherein the composition is comprised of, in mass %:

2,6-di-tert-butyl-4-methylcyclohexanone—0.2-0.3;
2,6-di-tert-butylphenol—0.7-6.0;
2-sec-butyl-6-tert-butyl-p-cresol—1.5-5.0;
4,6-di-tert-butyl-o-cresol—3.0-8.0;
2,4-di-tert-butylphenol—0.3-0.5;
2,4-di-tert-butyl-6-dimethylaminomethylphenol 2.0-5.0;
4,4-methylene-bis(2,6-di-tert-butylphenol) 0.1-0.3; and
2,6-di-tort-butyl-4-methylphenol—to the balance, dissolved in biodiesel fuel, and adding the solution of the composition to the biodiesel fuel to reach a concentration of 0.002 to 1.6 mass % based on the entire biodiesel fuel solution.

Another method for improving the storage stability of biodiesel fuel is to introduce an alkylphenol-based antioxidant additive in the form of a solution of the antioxidant additive composition to reach a concentration of the composition of from 0.002 to 1.6 mass % based on the entire biodiesel fuel solution.

The result of this method consists of using the aforementioned antioxidant additive which creates a long-lasting stabilizing effect with a reduced amount of the antioxidant additive added to biodiesel fuel. The used antioxidant additive inhibits precipitation during the shelf life of biodiesel fuel for a longer period of time.

DETAILED DESCRIPTION OF THE INVENTION

Biodisel fuel is produced by a known process, namely, transesterification of vegetable oils (triglycerides of higher fatty acids), for example, rapeseed oil, soybean oil, palm oil, or age-old dietary oil and fat, or animal fat, with methanol in the presence of an alkali (potassium or sodium hydroxide) intended to serve as a catalyst. Biodiesel fuel may further contain all ordinary additives that are added to, for example, improve the stability of the fuel in the winter season. Biodiesel fuels meet quality standards provided by DIN EN 14214 (this standard describes physical properties of all types of diesel fuels sold in the EC, Iceland, Norway, and Switzerland) and DIN 51606 (the German standard designed to be compatible with the engines of almost all major automakers).

The initial solution is provided by adding a melt of the aforementioned alkylphenol composition to biodiesel fuel under stirring at a temperature of from 40 to 150° C. to reach a concentration of the composition of from 6 to 48 mass % based on the initial solution.

The use of biodiesel fuel as the solvent for preparing the initial solution allows avoiding addition of undesirable additives to the biodiesel fuel.

The antioxidant additive composition is a solid material at room temperature. A solution containing from 6 to 48 mass % of the alkylphenol composition dissolved in biodiesel fuel is easy to be added to the biodiesel fuel under stirring at 20° C. to reach a concentration of the composition of from 0.002 to 1.6 mass % based on the entire biodiesel fuel solution.

The large-scale preparation of a solution having alkylphenol composition concentrations of less than 6 mass % based on the initial solution is impracticable due to the difficulty of accurate dosage and inappropriate for the reason that, as the concentration of the initial solution decreases, higher dosages of the initial solution are added to the biodiesel fuel to attain the required concentration of the alkylphenol composition in the biodiesel fuel.

It was discovered that, while providing the initial solution having a concentration of the alkylphenol composition of higher than 48 mass % based on the initial solution, a precipitations first appear upon temperature depression and cause clouding of the biodiesel fuel. Precipitation is due to the supersaturation of the initial solution with the alkylphenol composition.

Table 1 compiles comparative data on the solubility of the initial solution provided by adding BHT and the alkylphenol composition of the present invention to biodiesel fuel upon temperature depression. The alkylphenol composition of the present invention was as follows, in mass %:

2,6-di-tert-butyl-4-methylcyclohexanone—0.2;
2,6-di-tert-butylphenol—1.25;
2-sec-butyl-6-tert-butyl-p-cresol—2.0;
4,6-di-tert-butyl-o-cresol—3.2;
2,4-di-tert-butylphenol—0.5;
2,4-di-tert-butyl-6-dimethylaminomethylphenol—3.0;
4,4-methylene-bis(2,6-di-tert-butylphenol)—0.3; and
2,6-di-tert-butyl-4-methylphenol—to the balance.

TABLE 1

| Antioxidant additive Added to | Concentration of antioxidant additive | Temperature, ° C. | | | | | | | | | | | |
|---|---|---|---|---|---|---|---|---|---|---|---|---|---|
| biodiesel fuel | in the initial solution | 40 | 35 | 30 | 32 | 31 | 25 | 22 | 20 | 15 | 14 | 12 | 10 |
| BHT | 60 | s | s | s | s | ins | ins | ins | ins | ins | ins | ins | ins |
| Alkylphenol | 60 | s | s | s | s | s | s | ins | ins | ins | ins | ins | ins |
| composition | 48 | s | s | s | s | s | s | s | s | s | s | ins | ins |

s—soluble initial solution
ins—insoluble initial solution

The stabilizing effect of the claimed antioxidant additive is generated upon the attainment of the concentration of the alkylphenol composition in the biodiesel fuel of 0.002 mass % based on the entire biodiesel fuel solution. It was discovered that, when the concentration of the claimed alkylphenol composition in biodiesel fuel was less than 0.002 mass % based on the entire biodiesel solution, there was no stabilizing effect.

Concentrations of the alkylphenol composition in biodiesel higher than 1.6 mass % based on the entire biodiesel fuel solution are undesirable because of a risk of deterioration of the quality characteristics of the biodiesel fuel within the standard provided by DIN 51606.

The claimed method is further illustrated by embodiment examples, which follow.

Figure 2:
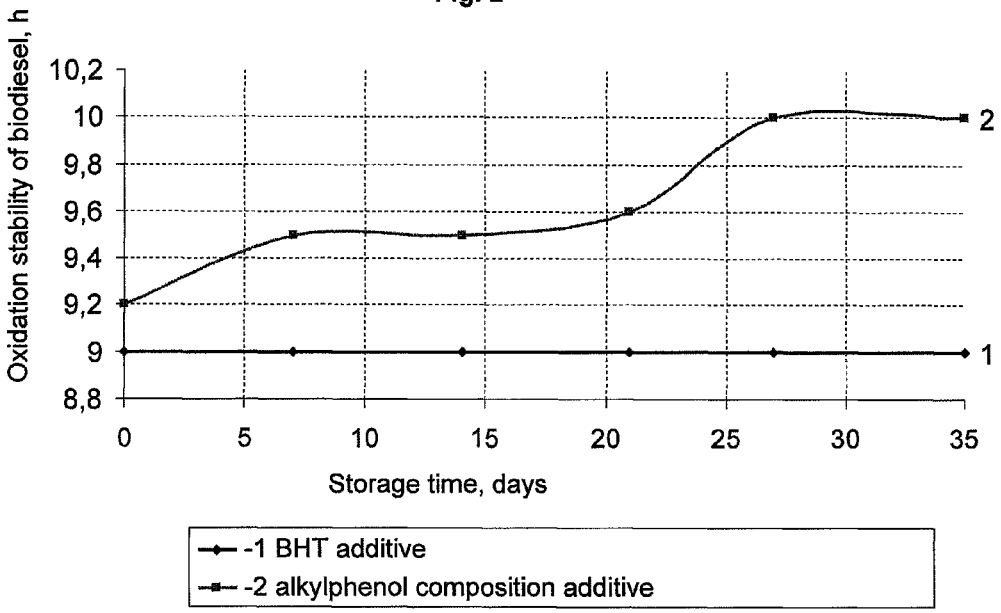

Some results of the examples are tabulated; some are represented as graphic images, which show the following:

FIG. 1 shows the oxidation stability of biodiesel fuel BHT and APC (alkyl phenol composition) as a function of the antioxidant additive amount; and FIG. 2 illustrates how an antioxidant additive affects the storage stability of biodiesel fuel.

To biodiesel fuel manufactured by a known method via transesterification of triglycerides of higher fatty acids with methanol in the presence of an alkali (potassium or sodium hydroxide) and having quality that met the standards of DIN EN 14214 and DIN 51606, added was the antioxidant additive of the present invention using the claimed method.

Accelerated oxidation tests in all examples were carried out using the Rancimat method according to DIN EN 14112 at 110° C.

Examples 1 to 4 studied the easiest-to-oxidize biodiesel fuel which was manufactured via transesterification of sunflower oil to which the antioxidant additive of the present invention was added in an amount of 3000 ppm (the concentration of the alkylphenol composition was 0.3 mass % based on the entire biodiesel fuel solution) using the claimed method with various alkylphenol compositions.

Example 1

Comparative

To biodiesel fuel added is the following alkylphenol composition, mass %:
2,6-di-tert-butyl-4-methylcyclohexanone—0.5;
2,6-di-tert-butylphenol—10.0;
2-sec-butyl-6-tert-butyl-p-cresol—8.0;
4,6-di-tert-butyl-o-cresol—10.0;
2,4-di-tert-butylphenol—1.0;
2,4-di-tert-butyl-6-dimethylaminomethylphenol—8.0;
4,4-methylene-bis(2,6-di-tert-butylphenol)—0.5; and
2,6-di-tert-butyl-4-methylphenol—to the balance.
The oxidation stability of the biodiesel fuel as determined by the Rancimat test at 110° C. is 6.5 h.

Example 2

According to the Invention

To biodiesel fuel added is the following alkylphenol composition, mass %:
2,6-di-tert-butyl-4-methylcyclohexanone—0.3;
2,6-di-tert-butylphenol—6.0;
2-sec-butyl-6-tert-butyl-p-cresol—5.0;
4,6-di-tert-butyl-o-cresol—8.0;
2,4-di-tert-butylphenol—0.5;
2,4-di-tort-butyl-6-dimethylaminomethylphenol—5.0;
4,4-methylene-bis(2,6-di-tert-butylphenol)—0.3; and
2,6-di-tort-butyl-4-methylphenol—to the balance.
The oxidation stability of the biodiesel fuel as determined by the Rancimat test at 110° C. is 9.2 h.

Example 3

According to the Invention

To biodiesel fuel added is the following alkylphenol composition, mass %:
2,6-di-tert-butyl-4-methylcyclohexanone—0.2;
2,6-di-tert-butylphenol—0.7;
2-sec-butyl-6-tort-butyl-p-cresol—1.5;
4,6-di-tert-butyl-o-cresol—3.0;
2,4-di-tert-butylphenol—0.3;
2,4-di-tort-butyl-6-dimethylaminomethylphenol—2.0;
4,4-methylene-bis(2,6-di-tert-butylphenol)—0.1; and
2,6-di-tert-butyl-4-methylphenol—to the balance.
The oxidation stability of the biodiesel fuel as determined by the Rancimat test at 110° C. is 9.4 h.

Example 4

Comparative

To biodiesel fuel added is the following alkylphenol composition, mass %:
2,6-di-tert-butyl-4-methylcyclohexanone—0.1;
2,6-di-tert-butylphenol—0.25;
2-sec-butyl-6-tert-butyl-p-cresol—1.0;
4,6-di-tert-butyl-o-cresol—2.2;
2,4-di-tert-butylphenol—0.2;
2,4-di-tert-butyl-6-dimethylaminomethylphenol—1.2;
4,4-methylene-bis(2,6-di-tert-butylphenol)—0.05; and
2,6-di-tert-butyl-4-methylphenol—to the balance.

The oxidation stability of the biodiesel as determined by the Rancimat test at 110° C. is 8.3 h.

The oxidation stability of biodiesel fuel decreases considerably in case where the alkylphenol proportion in the antioxidant additive added to the biodiesel is below the lower bound or above the upper bound of the composition. Herein, if the alkylphenol proportion in the antioxidant additive added to the biodiesel is above the upper bound, there is risk of deterioration of the quality characteristics of the biodiesel within the standard of DIN 51606.

Examples 5 to 11 provide data for the following alkylphenol compositions, mass %:
2,6-di-tert-butyl-4-methylcyclohexanone—0.25;
2,6-di-tert-butylphenol—2.25;
2-sec-butyl-6-tert-butyl-p-cresol—3.3;
4,6-di-tert-butyl-o-cresol—4.2;
2,4-di-tert-butylphenol—0.5;
2,4-di-tert-butyl-6-dimethylaminomethylphenol—4.0;
4,4-methylene-bis(2,6-di-tert-butylphenol)—0.2; and
2,6-di-tert-butyl-4-methylphenol—to the balance.

Examples 5 to 8

Table 2 compiles comparative data on the concentrations of antioxidant additives BHT and the alkylphenol composition (according to the invention) added to biodiesel fuels manufactured by transesterification of rapeseed oil (Example 5), sunflower oil (Example 6), soybean oil (Example 7), and dietary fat (Example 8), to attain approximately equal oxidation stabilities.

Data on the oxidation stability of biodiesel fuel free of antioxidant additives are provided for comparison.

The data compiled in Table 2 demonstrate that addition of antioxidant additives sharply increases the oxidation stability of biodiesel fuel. Herein, the amount of an antioxidant additive required for approximately equal oxidation stability to be attained, for the alkylphenol composition of the present invention is far smaller than for BHT.

TABLE 2

| Antioxidant additive to biodiesel fuel | Antioxidant additive concentration in the initial solution, ppm (mass %) | Oxidation stability by the Rancimat test at 110° C. h |
|---|---|---|
| | Example 5 | |
| No additive | — | 5.1 |
| BHT | 500 (0.05) | 7.1 |
| Alkylphenol composition | 300 (0.03) | 7.0 |
| | Example 6 | |
| No additive | — | 1.6 |
| BHT | 4000 (0.4) | 9.0 |
| Alkylphenol composition | 3000 (0.3) | 9.2 |
| | Example 7 | |
| No additive | — | 3.6 |
| BHT | 2000 (0.2) | 8.8 |
| Alkylphenol composition | 1550 (0.155) | 8.8 |
| | Example 8 | |
| No additive | — | 2.1 |
| BHT | 1500 (0.15) | 7.4 |
| Alkylphenol composition | 1150 (0.115) | 7.5 |

Table 3 compiles data on the concentrations of antioxidant additives BHT and the alkylphenol composition of the present invention added to biodiesel fuels produced by transesterification of sunflower oil, soybean oil, and dietary fat to achieve a tailored oxidation stability level of the biodiesel fuel of at least 6 h at 110° C. according to DIN EN 14214.

TABLE 3

| Antioxidant additive to biodiesel fuel | Source used to derive biodiesel | Antioxidant additive concentration, ppm (mass %) |
|---|---|---|
| BHT | Rapeseed oil | 450 (0.045) |
| | Sunflower oil | 2400 (0.24) |
| | Soybean oil | 600 (0.06) |
| | Dietary fat | 1000 (0.1) |
| Alkylphenol composition | Rapeseed oil | 300 (0.03) |
| | Sunflower oil | 1800 (0.18) |
| | Soybean oil | 450 (0.045) |
| | Dietary fat | 700 (0.07) |

Example 11

It was studied during one month how antioxidant additives BHT and the alkylphenol composition of the present invention affect the shelf life of the easiest-to-oxidize biodiesel fuel which was manufactured via transesterification of sunflower oil. Oxidation stability was measured in Rancimat storage tests at 110° C. in the beginning of the test and on the 7th day, 14th day, 21st day, 27th day, and 35th day of the test.

The results are displayed in Table 4.

TABLE 4

| Antioxidant additive to biodiesel fuel | Antioxidant additive concentration, | Oxidation stability in Rancimat storage tests at 110° C., h | | | | | |
|---|---|---|---|---|---|---|---|
| | | 0th day. | 7th day. | 14th day. | 21st day. | 27th day. | 35th day. |
| BHT | 4000 (0.4) | 9.0 | 9.0 | 9.0 | 9.0 | 9.0 | 9.0 |
| Alkylphenol composition | 3000 (0.3) | 9.2 | 9.5 | 9.5 | 9.6 | 10.0 | 10.0 |

Example 9

FIG. 1 displays comparative data on the concentrations of antioxidant additives BHT and the alkylphenol composition of the present invention added to the easiest-to-oxidize biodiesel fuel produced by transesterification of sunflower oil to achieve equal oxidation stabilities.

Herein, the alkylphenol composition was added to the biodiesel fuel to achieve the minimal concentration of the alkylphenol composition (20 ppm, or 0.002 mass %) based on the entire biodiesel fuel solution.

The data displayed in FIG. 1 prove that the amount of the antioxidant additive of the present invention providing the same oxidation stability is approximately 2.5 times as low.

Example 10

According to the requirements of DIN EN 14214, the minimal oxidation stability level of a biodiesel fuel at 110° C. should be at least 6 h.

FIG. 2 shows graphic representation of the results.

Both Table 4 and FIG. 2 show that, for biodiesel fuel with the antioxidant additive of the present invention, not only does the oxidation stability exceed the indices of BHT as an antioxidant additive, but it also increases even in a lower concentration.

Thus, the above examples demonstrate that the composition claimed for improving the storage stability of biodiesel fuel and the method for improving the stability of biodiesel fuel with the use of this composition provide a considerable lengthening of the shelf life time of the biodiesel fuel with a reduced amount of the additive.

What we claim is:

1. An alkylphenol-based antioxidant additive composition for stabilizing biodiesel fuel which consists of the following in mass %:

2,6-di-tert-butyl-4-methylcyclohexanone—0.2-0.3;

2,6-di-tert-butylphenol—0.7-6.0;

2-sec-butyl-6-tert-butyl-p-cresol—1.5-5.0;

4,6-di-tert-butyl-o-cresol—3.0-8.0;

2,4-di-tort-butylphenol—0.3-0.5;
2,4-di-tert-butyl-6-dimethylaminomethylphenol—2.0-5.0;
4,4-methylene-bis(2,6-di-tert-butylphenol)—0.1-0.3; and
2,6-di-tert-butyl-4-methylphenol—to the balance.

2. A solution of an alkylphenol-based antioxidant additive composition for addition to biodiesel fuel wherein the solution comprises the alkylphenol-based antioxidant additive composition which consists of the following in mass %:

2,6-di-tert-butyl-4-methylcyclohexanone—0.2-0.3;
2,6-di-tert-butylphenol—0.7-6.0;
2-sec-butyl-6-tert-butyl-p-cresol—1.5-5.0;
4,6-di-tert-butyl-o-cresol—3.0-8.0;
2,4-di-tert-butylphenol—0.3-0.5;
2,4-di-tert-butyl-6-dimethylaminomethylphenol—2.0-5.0;
4,4-methylene-bis(2,6-di-tert-butylphenol)—0.1-0.3; and
2,6-di-tert-butyl-4-methylphenol—to the balance, and a biodiesel fuel, wherein concentration of said composition is from 6 to 48 mass % based on mass of the solution.

3. A method for improving the storage stability of biodiesel fuel, the method comprises providing a solution of alkylphenol-based antioxidant additive composition containing from 6 to 48 mass % of said composition dissolved in a biodiesel fuel and adding the solution to biodiesel fuel to reach a concentration of the composition from 0.002 to 1.6 mass % based on the entire biodiesel fuel solution, wherein an alkylphenol-based antioxidant additive consists of the following in mass %:

2,6-di-tert-butyl-4-methylcyclohexanone—0.2-0.3;
2,6-di-tert-butylphenol—0.7-6.0;
2-sec-butyl-6-tert-butyl-p-cresol—1.5-5.0;
4,6-di-tert-butyl-o-cresol—3.0-8.0;
2,4-di-tert-butylphenol—0.3-0.5;
2,4-di-tert-butyl-6-dimethylaminomethylphenol—2.0-5.0;
4,4-methylene-bis(2,6-di-tert-butylphenol)—0.1-0.3; and
2,6-di-tert-butyl-4-methylphenol—to the balance.

* * * * *